United States Patent [19]

Fukasawa et al.

[11] Patent Number: 4,514,234

[45] Date of Patent: Apr. 30, 1985

[54] MOLYBDENUM BOARD AND PROCESS OF MANUFACTURING THE SAME

[75] Inventors: Yoshiharu Fukasawa; Tatsuhiko Matsumoto; Mituo Kawai; Shigeru Ueda, all of Yokohama; Hideo Koizumi, Tokyo; Hiroyuki Saitou, Yokohama, all of Japan

[73] Assignee: Tokyo Shibaura Denki Kabushiki Kaisha, Kawasaki, Japan

[21] Appl. No.: 578,580

[22] Filed: Feb. 9, 1984

[30] Foreign Application Priority Data

Feb. 10, 1983 [JP] Japan ..... 58-19779
Feb. 10, 1983 [JP] Japan ..... 58-19780

[51] Int. Cl.[3] ..... B22F 3/16

[52] U.S. Cl. ..... 148/11.5 P; 148/11.5 F; 148/423

[58] Field of Search ..... 148/423; 420/429; 148/11.5 F, 11.5 P

[56] References Cited

U.S. PATENT DOCUMENTS 2,666,721 1/1954 Bechtold et al. ..... 148/423
3,676,083 7/1972 Cheney et al. ..... 420/429

*Primary Examiner*—W. Stallard
*Attorney, Agent, or Firm*—Cushman, Darby & Cushman

[57] ABSTRACT

A molybdenum board which has excellent strength at high temperatures. The molybdenum board consists essentially of molybdenum recrystallized grains having a ratio L/W (L: length; W: width) of 2 or more and the width W of 5 to 1,000 μm and containing 0.005 to 0.75% by weight of at least one element selected from Al, Si and K.

10 Claims, 3 Drawing Figures

MOLYBDENUM BOARD AND PROCESS OF MANUFACTURING THE SAME

BACKGROUND OF THE INVENTION

1. Field of the Invention

The present invention relates to a molybdenum board which has excellent strength at high temperatures, and a process of manufacturing the same.

2. Description of the Prior Art

Molybdenum is used as a material of heat treatment jigs such as furnace heaters or heat treatment boats which are used at high temperatures since molybdenum has a high melting point and good heat-resistance properties. However, if a heat treatment jig obtained by working molybdenum board is used under conditions of high temperatures which are around the recrystallizing temperature of molybdenum or higher and involve heating/cooling, recrystallization occurs during the use of the jig, and deformation or cracking may occur due to thermal fatigue or creep. As time elapses, such deformation or cracking progresses to a degree, in case of using molybdenum to form furnace heaters, to cause abnormal contact with each other which causes short-circuiting and melting off of the heaters. Then, the temperature profile of the furnace heater becomes abnormal; local high temperatures or disconnection occurs. The furnace heater cannot then serve its intended purpose. Further, if heat treatment jigs such as sintering boats and mounting plates of sintered materials used in automatic lines for sintering oxides or carbides such as uranium dioxide ($UO_2$) at a temperature of about 1,500° C. or higher are deformed to a substantial degree, the sintered materials may fall down from the boats or plates. In an extreme case, the molybdenum boards contact each other and the sintered materials cannot be mounted thereon, thus, they become to be unable to accomplish their intended purposes. Further, when the thermal conductivity of the compounds to be sintered is different from that of molybdenum, the molybdenum jig is sometimes broken due to a stress generated in each heat treatment between the surface on which sintered material is mounted and other surfaces of the jig.

SUMMARY OF THE INVENTION

It is, therefore, an object of the present invention to provide a molybdenum board which does not cause deformation or cracking upon use at high temperatures and which has excellent strength, thermal fatigue characteristics and resistance to creep at high temperatures.

There is provided according to the present invention a molybdenum board consisting essentially of molybdenum recrystallized grains which have a ratio L/W (L: length; W: width) of 2 or more and a width W of 5 to 1,000 μm and which contain 0.005 to 0.75% by weight of one or more elements selected from the group consisting of Al, Si and K.

The molybdenum board of the present invention can be manufactured by subjecting a doped molybdenum sintered ingot containing 0.005 to 0.75% by weight of one or more elements selected from the group consisting of Al, Si and K to an area reduction working of a total working ratio of 85% or more, and heat-treating the thus treated sintered ingot at a temperature which falls within a range between a temperature higher than the recrystallizing temperature by 100° C. and 2,200° C.

The molybdenum board of the present invention does not easily cause deformation or cracking upon use at high temperatures and has excellent thermal fatigue characteristics and an excellent creep resistance.

DETAILED DESCRIPTION OF THE PREFERRED EMBODIMENTS

Figure 1:
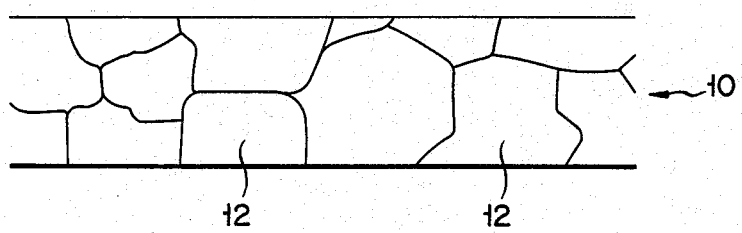
FIG. 1 PRIOR ART
FIG. 1 is a schematic view showing the crystallographic structure of a conventional molybdenum board.
Figure 2:
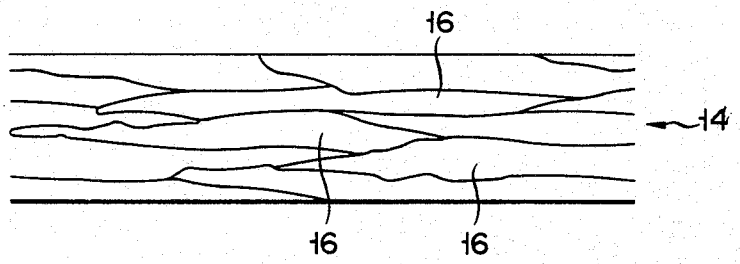
FIG. 2 is a schematic view showing the crystallographic structure of a molybdenum board of the present invention.

As shown in FIG. 1, a conventional molybdenum board 10 consists essentially of recrystallized grains 12 of the cubic system. In contrast, as shown in FIG. 2, a molybdenum board 14 of the present invention consists essentially of molybdenum recrystallized grains 16 having a ratio L/W (L: length; W: width) of 2 or more and a width W of 5 to 1,000 μm. The recrystallized molybdenum grains are doped with 0.005 to 0.75% by weight, preferably 0.01 to 0.6% by weight, of one or more elements selected from Al, Si and K. Advantageous effects can be obtained if the ratio L/W of the recrystallized grains is 2 or more, but is preferably 5 or more, and more preferably 15 or more. However, when the ratio L/W becomes too great, the strength of the board along the longitudinal direction of the recrystallized grains is decreased. In view of this, the ratio L/W is preferably 50 or less in practice. It is also to be noted that the width W of the recrystallized grains is preferably 20 to 500 μm.

In addition to the dopants described above, the recrystallized grains constituting the molybdenum board of the present invention preferably contain 0.3 to 3% by weight of one or more compounds (to be referred to as additives hereinafter) selected from the group consisting of oxides, carbides, borides and nitrides of La, Ce, Dy, Y, Th, Ti, Zr, Nb, Ta, Hf, V, Cr, Mo, W and Mg. When such compound or compounds are uniformly dispersed in the molybdenum grains, the strength of the molybdenum board at high temperatures is improved.

The molybdenum board of the present invention can be manufactured by the following process.

First, a molybdenum metal powder having an average grain size of about 1 to 10 μm, which contains 0.005 to 0.75% by weight of one or more compounds of elements selected from the group consisting of Al, Si and K is prepared. This can be accomplished by, for example, mixing molybdenum oxide (solution) with $Al_2O_3$, $SiO_2$, $K_2O_3$, and/or KCl, and then reducing the mixture; or mixing molybdenum powder with $Al_2O_3$, $SiO_2$, $K_2O$, and/or KCl powder and then reducing the mixture. When an additive is to be added, a fine additive powder having an average grain size of about 1 μm or less is uniformly dispersed in the mixture. Preparation of the dispersion can be performed by homogeneously mixing the powders in a pot roller. It is also preferable to mix the mixture with a solution or suspension of a selected additive. A more homogeneous dispersion is obtained in this case.

The resultant mixture is pressed at a pressure of about 1 to 4 tons/cm$^2$. The green compact obtained is sintered by a heat treatment at about 1,600 to 2,000° C. for about 1 to 10 hours to provide a sintered ingot.

The sintered ingot is then subjected to an area reduction working such as forging or rolling. The total working ratio of the area reduction working is 85% or more and is preferably 95% or more. Note that the total working ratio used herein indicates a value which is obtained by dividing by the thickness of the sintered ingot the difference between the thickness of the sintered ingot and the final product molybdenum board, and multiplying the quotient with 100.

Finally, the board obtained by the area reduction working is subjected to a heat treatment at a temperature which falls within a range between a temperature higher than the recrystallizing temperature of the doped molybdenum by 100° C. and 2,200° C. for about 0.1 to 10 hours so as to grow thin, long recrystallized grains such that the recrystallized grains have a ratio L/W of 2 or more and a width W of 5 to 1,000 μm. The recrystallizing temperature differs in accordance with the composition of the doped molybdenum but generally falls within a range of 1,200 to 1,900° C.

In the process described above, it is preferable that a preliminary area reduction working of a working ratio between 45% inclusive and 85% exclusive is performed, that a preliminary recrystallization treatment is then performed at a temperature higher than the recrystallizing temperature by 200 to 800° C., and thereafter that the area reduction working of the total working ratio of 85% or more is performed. When this modified process is adopted, the size of the recrystallized grains formed upon the final heat treatment can be rendered uniform, and local variations in the strength of the molybdenum board can be prevented. This step is adopted because it is preferable to perform a preliminary area reduction working of a relatively small working ratio and a subsequent preliminary recrystallization treatment so as to grow recrystallized grains of uniform size before the final treatment. The preliminary recrystallization treatment is performed at a temperature higher than the recrystallizing temperature by 200 to 800° C. for 1 to 10 hours. When the heating temperature falls within these temperatures, the preferable growth of recrystallized grains is got enough.

The reasons of setting specific values for the different conditions of the molybdenum board and the process of manufacturing the same of the present invention as described above will now be described.

The ratio L/W of the recrystallized grains of the molybdenum board is set to be 2 or more and the width W thereof is set to fall within the range of 5 to 1,000 μm for the following reason. When the ratio L/W and the width W fall within these ranges, the strength of the board at high temperatures higher than the recrystallizing temperature is improved.

A dopant or dopants selected from Al, Si and K are added for forming fine aligned doping holes by heat treatment after the area reduction working as the recrystallized grains grow sufficiently big through the effect of fine doping holes. This advantageous effect becomes great when the dopant or dopants is 0.005% by weight, and continues to be great until 0.75% by weight. When the amount of the dopant or dopants exceeds 0.75% by weight, the fine doping holes formed may be sometimes too big and too great in number.

An additive as described above is added so as to provide a strengthening effect by dispersion thereof and facilitating the thin, long growth of crystals during recrystallization, so that the resultant molybdenum board consisting essentially of a doped molybdenum material has high strength at high temperatures. When the amount of the additional impurity is 0.3% by weight or more, the effect becomes great while the amount is too much, it becomes difficult to uniformly disperse a fine additive.

In the process of manufacturing a molybdenum board according to the present invention, a total working ratio is necessary which can allow thin, long growth of recrystallized grains upon the subsequent heat treatment. When the total working ratio is 85% or more, satisfactory processed state may be obtained. More particularly, when the total working ratio is 85% or more, sufficient development of fibrous texture can be obtained and after a heat treatment after working, recrystallized grains become fibrous thin and long crystals. When the resultant board is used at high temperatures, abnormal deformation or intergranular cracking due to intergranular sliding may not be caused. Accordingly, the total working ratio should remain 85% or more and preferably 95% or more. However, a working ratio of 100% is theoretically impossible.

In the process of manufacturing a molybdenum board according to the present invention, the heat-treating temperature is set to fall within a range between a temperature higher than the recrystallizing temperature by 100° C. and 2,200° C. When the heat-treating temperature falls within this range, the recrystallized grains are thin and long, are coupled in a zigzag manner, and have excellent thermal fatigue characteristics and have excellent creep resistance at high temperatures.

The molybdenum board of the present invention has an excellent strength at high temperatures. Therefore, if the parts which are used at high temperatures such as a furnace heater, a deposition boat, a high-temperature heat-treatment jig, a $UO_2$ pellet sintering jig or the like are manufactured using such a board, an excellent strength is obtained.

EXAMPLES 1 AND 2

A molybdenum powder having an average particle size of 4 μm to which 0.015% by weight, respectively, of $Al_2O_3$, $SiO_2$, and $K_2O$ powder were added was pressed at a pressure of 2 tons/cm$^2$ to obtain green compacts containing about 0.01% by weight of Al, Si and K. The green compacts were sintered at 1,830° C. for 9 hours to provide sintered ingots.

The sintered ingots were forged at a temperature falling within a range of 1,100 to 1,400° C. and were thereafter rolled at a temperature falling within a range of 300 to 1,100° C. at a working ratio of 82%, 86% or 98% to provide boards having a thickness of 2 mm.

Four sample elements were cut from each of the molybdenum boards; the respective sample elements of each board were respectively subjected to a 2-hour heat-treatment at 1,650° C. corresponding to the recrystallizing temperature of the material used, 1,000° C. corresponding to an annealing temperature to remove distortion which is sufficiently lower than the recrystallizing temperature, 2,000° C. higher than the recrystallizing temperature by 350° C., and 2,400° C.

Figure 3:
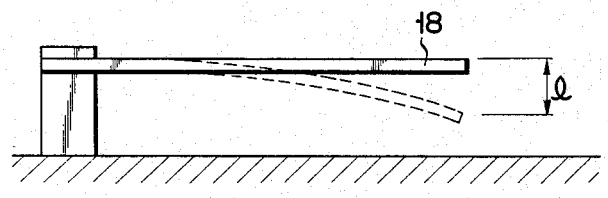
FIG. 3 explains the testing method of thermal fatigue characteristics of a molybdenum board.

A sample having a width of 10 mm and a length of 100 mm was cut from each sample element, and one end of a sample 18 thus obtained was fixed as shown in FIG. 3. The sample was subjected to 20 heat cycles, each cycle consisting of exposure to a hydrogen flow at 1,800° C. for 10 hours and to room temperature for 1 hour. The amount of deformation l due to the weight of the sample 18 was measured at its distal end. The ratios L/W and widths W of the samples were determined upon observation of the samples with a microscope. The obtained results are shown in Table 1 below.

TABLE 1

| | Working ratio (%) | Heat-treating temperature (°C.) | Deformation after heat cycle at 1,800° C. and room temperature l (mm) | L/W | W (μm) |
|---|---|---|---|---|---|
| Comparative Example 1 | 82 | 1,000 | 40 or more (too much deformation to cause contact with a base) | *(1) | — |
| Comparative Example 2 | | 1,650 | 40 or more (too much deformation to cause contact with a base) | 1 | 10 |
| Comparative Example 3 | | 2,000 | 40 or more (too much deformation to cause contact with a base) | 1 | 250 |
| Comparative Example 4 | | 2,400 | Fractured during testing | 1 | 480 |
| Comparative Example 5 | 86 | 1,000 | 21.3 | *(1) | — |
| Comparative Example 6 | | 1,650 | 15.2 | 1.5 | 20 |
| Example 1 | | 2,000 | 17.5 | 7 | 190 |
| Comparative Example 7 | | 2,400 | 40 or more (too much deformation to cause contact with a base) | 1~5 *(2) | 5~330 |
| Comparative Example 8 | 98 | 1,000 | 14.3 | *(1) | — |
| Comparative Example 9 | | 1,650 | 12.5 | 18 *(3) | 8 |
| Example 2 | | 2,000 | 1.25 | 26 | 320 |
| Comparative Example 10 | | 2,400 | 10.45 | 1~20 *(2) | 5~670 |

*(1) Non-crystallized fine fiber
*(2) Mixture of cubic crystals and thin, long crystals
*(3) Partly non-crystallized fine fiber It is seen from Table 1 above that the molybdenum boards of Examples 1 and 2 have considerably small deformations, and excellent thermal fatigue characteristics and creep resistance as compared with the boards of Comparative Examples 1 to 10.

EXAMPLE 3

A sintered ingot obtained in the above Examples was hot-worked (preliminary area reduction treatment) at a temperature falling within a range of 1,100 to 1,400° C. and a working ratio of 70%. The ingot was then subjected to a preliminary recrystallization treatment at 2,000° C. higher than the recrystallizing temperature by 350° C. for 1 hour.

The board was then subjected to an area reduction treatment of a working ratio of 98% in the same manner as in the above Examples to provide a molybdenum board having a thickness of 2.0 mm. The board was treated in the same manner as in the above Examples, and the ratio L/W and the width W of the resultant board were measured. The amount of deformation was measured to be 1.15 mm, the ratio L/W was measured to be 27, and the width W was measured to be 280 μm. It is seen from these results that the thermal fatigue characteristics and creep resistance are further improved when a preliminary area reduction treatment and a preliminary recrystallization treatment are performed.

EXAMPLES 4 AND 5

The procedures of Examples 1 and 2 were followed except that the sintered ingot contained 1.0% by weight of $La_2O_3$. The obtained results are shown in Table 2. It is seen from Table 2 that addition of an additive improves thermal fatigue characteristics and creep resistance.

TABLE 2

| | Working ratio (%) | Heat-treating temperature (°C.) | Deformation after heat cycle at 1,800° C. and room temperature l (mm) | L/W | W (μm) |
|---|---|---|---|---|---|
| Comparative Example 11 | 82 | 1,000 | 40 or more (too much deformation to cause contact with a base) | *(1) | — |
| Comparative Example 12 | | 1,650 | 40 or more (too much deformation to cause contact with a base) | 1 | 5 |
| Comparative Example 13 | | 2,000 | 40 or more (too much deformation to cause contact with a base) | 1 | 200 |
| Comparative Example 14 | | 2,400 | 40 or more (too much deformation to cause contact with a base) | 1 | 430 |
| Comparative Example 15 | 86 | 1,000 | 19.6 | *(1) | — |
| Comparative Example 16 | | 1,650 | 13.5 | 1.5 *(3) | 10 |
| Example 4 | | 2,000 | 1.3 | 8 | 230 |
| Comparative Example 17 | | 2,400 | 10.8 | 1~4 *(2) | 10~480 |
| Comparative Example 18 | 98 | 1,000 | 12.3 | *(1) | — |
| Comparative Example 19 | | 1,650 | 11.8 | 13 *(3) | 9 |
| Example 5 | | 2,000 | 1.1 | 25 | 250 |
| Comparative Example 20 | | 2,400 | 7.4 | 1~28 *(2) | 6~520 |

EXAMPLE 6

The same procedures as those in Example 3 were followed except that the sintered ingot contained 1.0% by weight of $La_2O_3$. The amount of deformation of the resultant board was measured to be 1.0 mm, the ratio L/W was measured to be 23, and the width W was measured to be 290 μm. It is thus seen that a preliminary area reduction treatment and a preliminary recrystallization treatment can further improve thermal fatigue characteristics and creep resistance.

EXAMPLES 7–16

The same procedures as those in Example 1 were followed except that the sintered ingot contained 1.0% by weight of $ZrO_2$, $Y_2O_3$, $Cr_2O_3$, MgO, ZrN, HfC, TaC, $ZrB_2$, or $NbB_2$. The obtained results are shown in Table 3. It can be seen from Table 3 that addition of a prescribed additive can further improve thermal fatigue characteristics and creep resistance.

TABLE 3

| Example 7 | Additive | Deformation l (mm) | L/W | W (μm) |
|---|---|---|---|---|
| Example 8 | $ZrO_2$ | 0.80 | 27 | 210 |
| Example 9 | $Y_2O_3$ | 1.03 | 25 | 190 |
| Example 10 | $Cr_2O_3$ | 1.10 | 24 | 240 |
| Example 11 | MgO | 0.94 | 25 | 250 |
| Example 12 | ZrN | 0.95 | 23 | 200 |
| Example 13 | HfC | 0.75 | 26 | 230 |
| Example 14 | TaC | 1.07 | 21 | 210 |
| Example 15 | $ZrB_2$ | 0.98 | 28 | 210 |
| Example 16 | $NbB_2$ | 1.12 | 24 | 220 |

What is claimed is:

1. A molybdenum board consisting essentially of molybdenum recrystallized grains having a ratio L/W of not less than 2 and a W of 5 to 1,000 μm and containing 0.005 to 0.75% by weight of at least one element selected from the group consisting of aluminum, silicon and potassium.

2. The molybdenum board according to claim 1, wherein W is 190 to 500 μm.

3. The molybdenum board according to claim 1, wherein the ratio L/W is 5 to 50, and the W is 20 to 500 μm.

4. A molybdenum board consisting essentially of molybdenum recrystallized grains having a L/W ratio of not less than 2 and a W of 5 to 1,000 μm, said molybdenum recrystallized grains containing (a) 0.005 to 0.75% by weight of at least one element selected from the group consisting of aluminum, silicon and potassium and (b) from 0.3 to 3% by weight of at least one element selected from the group consisting of oxides, carbides, borides, and nitrides of lanthanum, cerium, dysprosium, yttrium, thorium, titanium, zirconium, niobium, tantalum, hafnium, vanadium, chromium, molybdenum, tungsten, and magnesium.

5. A process of manufacturing the doped molybdenum board of claim 1, comprising the successive steps of:

providing a molybdenum sintered ingot containing 0.005 to 0.75% by weight of at least one element selected from the group consisting of aluminum, silicon and potassium;

performing an area reduction working of the sintered ingot and at a temperature between 300° to 1,100° C. and at a total working ratio of not less than 85%; and heat-treating the treated sintered ingot at a temperature which falls within a range between a temperature higher than a recrystallizing temperature by 100° C. and 2,200° C.

6. The process according to claim 5, further comprising the steps of performing a preliminary area reduction working at a working ratio between 45% inclusive and 85% exclusive and subsequently performing a preliminary recrystallization treatment at a temperature higher than the recrystallizing temperature by 200° to 800° C. before the step of the area reduction treatment.

7. The process according to claim 5, wherein the total working ratio is not less than 95%.

8. A process of manufacturing the molybdenum board of claim 4, comprising the steps of:

providing a molybdenum sintered ingot containing 0.005 to 0.75% by weight of at least one element selected from the group consisting of aluminum, silicon and potassium, and 0.3 to 3% by weight of at least one element selected from the group consisting of oxides, carbides, borides, and nitrides of lanthanum, cerium, dysprosium, yttrium, thorium, titanium, zirconium, niobium, tantalum, hafnium, vanadium, chromium, molybdenum, tungsten, and magnesium;

performing an area reduction working of the sintered ingot at a total working ratio of not less than 85%; and heat-treating the thus treated sintered ingot at a temperature which falls within a range between a temperature higher than a recrystallizing temperature by 100° C. and 2,200° C.

9. The process according to claim 8, further comprising the steps of performing a preliminary area reduction working at a working ratio between 45% inclusive and 85% exclusive and subsequently performing a preliminary recrystallization treatment at a temperature higher than the recrystallizing temperature by 200° to 800° C. before the step of the area reduction working.

10. The process according to claim 8, wherein the total working ratio is not less than 95%.

* * * * *